US012091280B2

(12) United States Patent
Chike

(10) Patent No.: US 12,091,280 B2
(45) Date of Patent: Sep. 17, 2024

(54) CONVEYANCE APPARATUS

(71) Applicant: Kohei Chike, Kanagawa (JP)

(72) Inventor: Kohei Chike, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 324 days.

(21) Appl. No.: 17/829,626

(22) Filed: Jun. 1, 2022

(65) Prior Publication Data

US 2023/0037177 A1 Feb. 2, 2023

(30) Foreign Application Priority Data

Jul. 28, 2021 (JP) ..... 2021-123403

(51) Int. Cl.
*B65H 5/06* (2006.01)
*B65H 7/20* (2006.01)

(52) U.S. Cl.
CPC ..... *B65H 7/20* (2013.01); *B65H 5/062* (2013.01); *B65H 2551/11* (2013.01); *B65H 2557/64* (2013.01)

(58) Field of Classification Search
CPC ..... B65H 5/062; B65H 7/20; B65H 2551/11; B65H 2557/64; B41J 11/0095; B41J 13/08; B41J 13/0009; B41J 13/02; G03G 15/70
See application file for complete search history.

(56) References Cited

U.S. PATENT DOCUMENTS

2009/0110411 A1* 4/2009 Gungor ..... G03G 15/5087 399/20
2012/0249648 A1 10/2012 Katayama
2014/0218755 A1 8/2014 Sasami
2017/0008724 A1 1/2017 Satsukawa

FOREIGN PATENT DOCUMENTS

| | | | |
|---|---|---|---|
| CN | 104003240 | * | 8/2014 |
| EP | 1790487 | A1 | 5/2007 |
| JP | 2013184765 | A | 9/2013 |
| JP | 2014-188861 | | 10/2014 |
| JP | 2016-161589 | | 9/2016 |

OTHER PUBLICATIONS

European Search Report; Application EP22177551; Nov. 8, 2022.

* cited by examiner

*Primary Examiner* — Christopher E Mahoney
*Assistant Examiner* — Marissa Ferguson-Samreth
(74) *Attorney, Agent, or Firm* — Duft & Bornsen, PC

(57) ABSTRACT

A conveyance apparatus includes a bearing rotator, an entrance rotator, an exit rotator, a first driver circuit, a downstream conveyor, a second driver circuit, and a recording medium detector. The entrance rotator receives a recording medium at a first position. The downstream conveyor receives the medium at a second position. As a process of removing the medium, the first driver circuit starts rotation operation after the second driver circuit starts driving the downstream conveyor and rotates the rotators for not less than a period of time for the medium to be conveyed from the first position to the second position. The second driver circuit continues driving the downstream conveyor for not less than a period of time for the medium to be conveyed from the second position to a position at which the medium is detected after the rotation operation of the first driver circuit is stopped.

8 Claims, 12 Drawing Sheets

CONVEYANCE APPARATUS

CROSS-REFERENCE TO RELATED APPLICATIONS

This patent application is based on and claims priority pursuant to 35 U.S.C. § 119(a) to Japanese Patent Application No. 2021-123403, filed on Jul. 28, 2021, in the Japan Patent Office, the entire disclosure of which is hereby incorporated by reference herein.

BACKGROUND

Technical Field

Embodiments of the present disclosure relate to a conveyance apparatus.

Related Art

In image forming apparatuses as an example of conveyance apparatuses, an operation of detecting the presence of a remaining sheet in the conveyance apparatus and prompting a user to remove the remaining sheet is widely known as an initialization process before printing is performed. For example, when an image forming apparatus transfers ink onto the sheet, the image forming apparatus grips a leading end of a sheet as a print medium with a holder called a gripper and brings the sheet into close contact with a cylindrical drum to perform printing while conveying the sheet. In such an image forming apparatus, an entrance rotator (entrance drum), an image forming conveyance drum, and an exit rotator (exit drum), which serve as an image forming unit, convey the sheet while the gripper grips the leading end of the sheet. When the gripper of the exit drum releases the leading end of the sheet at a delivery position, the sheet is conveyed downstream to a fixing device for drying the sheet.

Further, a technology is known in which, for example, a drive system in an image forming apparatus is moved for a predetermined period of time as a method for detecting and removing a remaining sheet in an initialization process.

As such an image forming apparatus, an image forming apparatus known in the art includes a conveyance device for conveying a print medium, an ink fixing device, a detector for detecting a conveyance failure, and a controller for reducing a recovery time from the conveyance failure. Further, an image forming apparatus known in the art includes a body, an optional sheet ejection device, a controller, and a control unit for ejecting remaining sheets remaining inside the image forming apparatus while reducing peak power consumption at the 5 time of power-on of the image forming apparatus.

SUMMARY

In an embodiment of the present disclosure, a conveyance apparatus includes a bearing rotator, an entrance rotator, an exit rotator, a first driver circuit, a downstream conveyor, a second driver circuit, and a recording medium detector. The bearing rotator rotates, while bearing a recording medium, to convey the recording medium. The entrance rotator receives, at a first position, the recording medium fed from upstream in a recording medium conveyance direction and delivers the recording medium to the bearing rotator while rotating to convey the recording medium. The exit rotator receives the recording medium conveyed by rotation of the bearing rotator and delivers the recording medium at a second position downstream in the recording medium conveyance direction while rotating to convey the recording medium. The first driver circuit rotates the bearing rotator, the entrance rotator, and the exit rotator. The downstream conveyor receives, at the second position, the recording medium conveyed by rotation of the exit rotator and conveys the recording medium downstream in the recording medium conveyance direction. The second driver circuit drives the downstream conveyor for conveyance. The recording medium detector detects the recording medium on a conveyance path on which the recording medium is conveyed by the downstream conveyor. As a process of removing the recording medium remaining on at least one of the bearing rotator, the entrance rotator, or the exit rotator, the first driver circuit starts rotation operation after the second driver circuit starts driving the downstream conveyor for conveyance, and rotates the bearing rotator, the entrance rotator, and the exit rotator for a period of time equal to or longer than a period of time taken for the recording medium to be conveyed from the first position to the second position. The second driver circuit continues driving the downstream conveyor for conveyance for a period of time equal to or longer than 5 a period of time taken for the recording medium to be conveyed from the second position to a position at which the recording medium is detected by the recording medium detector after the rotation operation of the first driver circuit is stopped.

According to another embodiment of the present disclosure, an image forming apparatus includes the conveyance apparatus.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
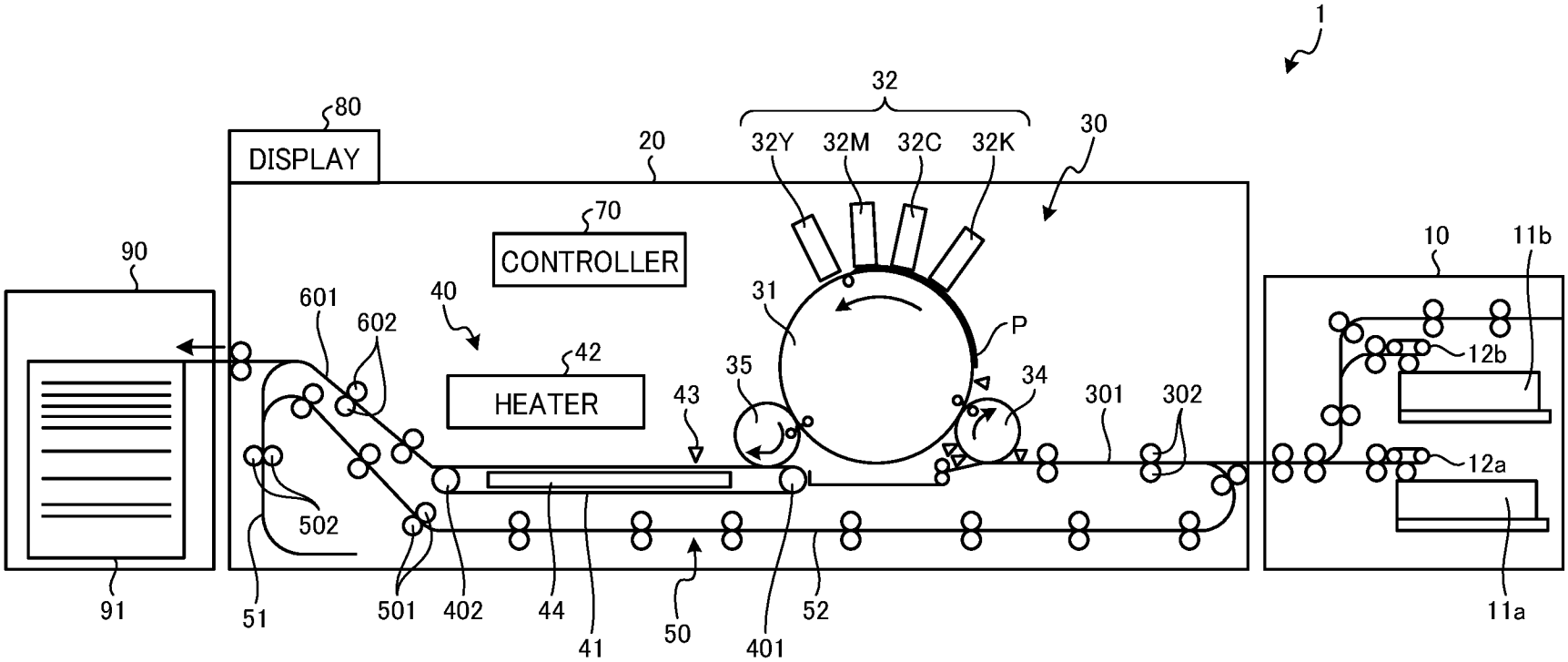
FIG. 1 is a diagram illustrating an overall configuration of an image forming apparatus according to an embodiment of the present disclosure.

The accompanying drawings are intended to depict embodiments of the present invention and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

Hereinafter, a conveyance apparatus according to embodiments of the present disclosure is described in detail with reference to the drawings. The present disclosure is not limited by the following embodiments, and the components and elements in the following embodiments include those that can be easily conceived from the components and elements by those skilled in the art, substantially the same components and elements, and so-called equivalent ranges of components and elements. Various omissions, substitutions, changes, and combinations of components and elements can be made without departing from the gist of the following embodiments.

Overall Configuration of Image Forming Apparatus

Figure 2:
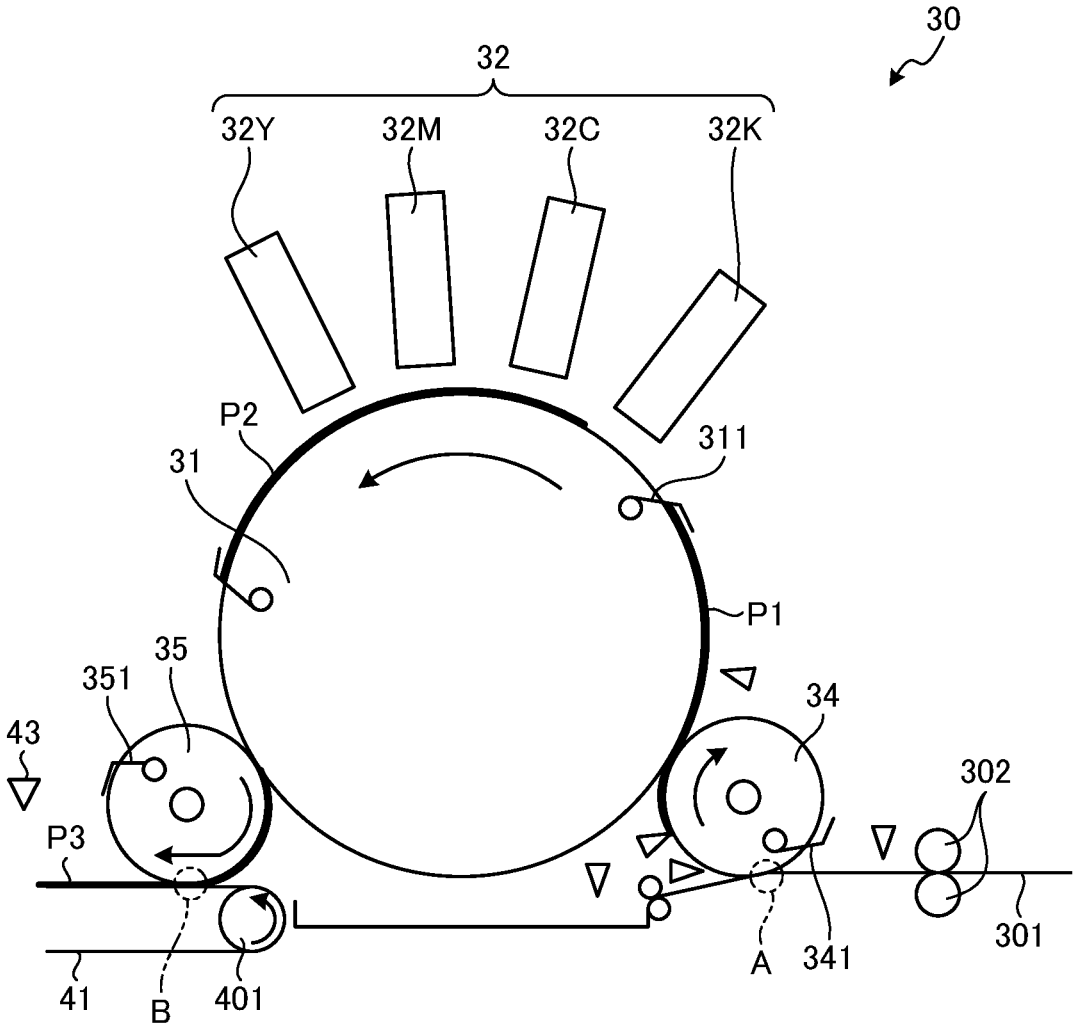
FIG. 2 is a diagram illustrating a configuration of an image forming device provided for the image forming apparatus of FIG. 1.

FIG. 1 is a diagram illustrating an overall configuration of an image forming apparatus 1 according to an embodiment of the present embodiment. FIG. 2 is a diagram illustrating a configuration of an image forming device 30 provided for the image forming apparatus 1, according to the present embodiment. The overall configuration of the image forming apparatus 1 according to the present embodiment is described with reference to FIGS. 1 and 2.

The image forming apparatus 1 illustrated in FIG. 1 forms an image on a fed sheet by an inkjet method using a line head and then ejects the sheet as an example of a conveyance apparatus. As illustrated in FIG. 1, the image forming apparatus 1 includes a sheet carry-in device 10, a printer 20, and a sheet carry-out device 90.

The sheet carry-in device 10 is a device for carrying in a sheet P as a sheet-shaped print medium as an example of recording medium. As illustrated in FIG. 1, the sheet carry-in device 10 includes a lower carry-in tray 11*a* and an upper carry-in tray 11*b* for accommodating multiple sheets P, a sheet feeding device 12*a* for separating sheets P one by one from the lower carry-in tray 11*a* and feeding out the sheets P, and a sheet feeding device 12*b* for separating the sheets P one by one from the upper carry-in tray 11*b* and feeding out the sheet P. The sheet carry-in device 10 feeds the sheet P fed out by the sheet feeding device 12*a* and the sheet feeding device 12*b* to the image forming device 30. Note that, for example, a pretreatment device for applying a coating liquid such as a pretreatment liquid to the sheet P may be disposed between the sheet carry-in device 10 and the printer 20.

The printer 20 is a device that discharges ink onto the sheet P supplied from the sheet carry-in device 10 by an inkjet method using a line head to form an image. As illustrated in FIG. 1, the printer 20 includes an image forming device 30, a fixing device 40, a duplex mechanism 50, a controller 70, and a display 80 as an example of a notification device.

In the image forming device 30, a liquid discharger 32 discharges the ink onto the sheet P, which is supplied from the sheet carry-in device 10 and conveyed on a carry-in path 301 by a conveyance roller pair 302, to form an image on the sheet P. As illustrated in FIG. 2, the image forming device 30 includes a drum 31 as a bearing rotator, the liquid discharger 32, an entrance rotator 34, and an exit rotator 35.

The drum 31 includes a gripper 311 that serves as a gripper. The drum 31 is a rotator that conveys the sheet P by rotation operation while gripping a leading end of the sheet P fed from the entrance rotator 34 by the gripper 311. A plurality of suction holes are formed on a peripheral surface of the drum 31 in a dispersed manner, and suction air flows are generated from the plurality of suction holes inward of the drum 31 by a suction device. Thus, the sheet P is attracted and borne on the peripheral surface of the drum 31.

The liquid discharger 32 discharges ink onto the sheet P conveyed by the rotation operation of the drum 31 to form an image on the sheet P. The liquid discharger 32 includes a liquid discharge unit 32C for discharging cyan (C) ink, a liquid discharge unit 32M for discharging magenta (M) ink, a liquid discharge unit 32Y for discharging yellow (Y) ink, and a liquid discharge unit 32K for discharging black (K) ink. Note that color of the ink is not limited to cyan, magenta, yellow, and black, and the liquid discharger 32 may include a liquid discharge unit for discharging a special ink such as a white ink, a gold ink, a silver ink or a fluorescent ink.

The discharge operation of the liquid discharger 32 is controlled by drive signals corresponding to print data. When the sheet P borne on the drum 31 passes through a region of the peripheral surface of the drum 31 facing the liquid discharger 32, ink of each color is discharged from the liquid discharger 32. Thus, an image corresponding to the print data is formed and printed on the sheet P. The sheet P on which the image has been formed is conveyed from the drum 31 to the exit rotator 35.

The entrance rotator 34 receives the sheet P fed from upstream in a recording medium conveyance direction at a receiving position A, i.e., a first position and transfers the sheet P between the drum 31 and the entrance rotator 34. A gripper 341 that serves as a gripper, is disposed on an outer peripheral region of the entrance rotator 34. The sheet P conveyed on the carry-in path 301 by the conveyance roller pair 302 is gripped by the gripper 341 at the receiving position A, and the sheet P is conveyed to the drum 31 by the rotation operation of the entrance rotator 34. A leading end of the sheet P is gripped by the gripper 341 and the sheet P is conveyed along with the rotation of the entrance rotator 34 and is delivered to the drum 31 at a position at which the entrance rotator 34 and the drum 31 face each other.

The exit rotator 35 receives the sheet P conveyed by the rotation of the drum 31 and delivers the sheet P to the fixing device 40 at a delivery position B, i.e., a second position. A gripper 351 that serves as a gripper is disposed on an outer peripheral region of the exit rotator 35. The sheet P conveyed by the rotation of the drum 31 is held by the gripper 351 and the sheet P is conveyed to a conveyance belt 41 of the fixing device 40 by the rotation operation of the exit rotator 35. The gripper 351 moves around in synchronization so as to match the position of the gripper 311 of the drum 31. Accordingly, the leading end of the sheet P can be delivered to the fixing device 40. Note that the exit rotator 35 may be coupled to the entrance rotator 34 via a gear and rotate in conjunction with the entrance rotator 34.

The fixing device 40 dries and fixes ink on the sheet P on which an image has been formed by the image forming device 30. Accordingly, liquid such as water in the ink on the sheet P evaporates and colorant contained in the ink is fixed on the sheet P. Thus, the curl of the sheet P is reduced. As illustrated in FIG. 1, the fixing device 40 includes the conveyance belt 41 as a downstream conveyor, a heater 42, a sheet detection sensor 43 as a recording medium detector, and a suction device 44.

The conveyance belt 41 is an endless belt stretched between a drive roller 401 and a driven roller 402 and conveys the sheet P received from the exit rotator 35. When the conveyance belt 41 conveys the sheet P, the conveyance belt 41 conveys the sheet P downstream in the recording medium conveyance direction such that the sheet P passes through the heater 42 at a predetermined conveyance speed. The conveyance speed of the sheet P conveyed by the conveyance belt 41 is set by the rotation speed of the drive roller 401. The rotation speed of the drive roller 401 is controlled by the controller 70. When the leading end of the sheet P is separated from the exit rotator 35 and transferred to the conveyance belt 41, the rotation speed of the drive roller 401 is adjusted so that the conveyance belt 41 operates at the predetermined conveyance speed. Further, a plurality of suction holes are formed in a dispersed manner on a surface of the conveyance belt 41, and the sheet P is attracted and borne on the conveyance belt 41 by suction air flows from the suction device 44.

The heater 42 heats the sheet P conveyed by the conveyance belt 41. The heater 42 heats the sheet P to dry and fix the ink on the sheet P.

The sheet detection sensor 43 detects the sheet P that has been transferred from the exit rotator 35 to the conveyance belt 41 at the transfer position B and conveyed to the fixing device 40.

The suction device 44 generates the suction air flows that are sucked through the multiple suction holes formed on the surface of the conveyance belt 41 by a suction operation and causes the sheet P to be attracted to the conveyance belt 41.

The sheet P that has passed through the fixing device 40 is conveyed by the rotation of a conveyance roller pair 602 through an ejection path 601 and is sent to the duplex mechanism 50 or the sheet carry-out device 90.

When both sides of the sheet P are to be printed, the duplex mechanism 50 reverses the sheet P that has passed through the fixing device 40 and feeds the sheet P again upstream from the image forming device 30 in the recording medium conveyance direction, i.e., to the carry-in path 301. As illustrated in FIG. 1, the duplex mechanism 50 includes a reverse path 51 and a duplex path 52.

The reverse path 51 is a path on which the sheet P that has passed through the fixing device 40 is received and reversed by the rotation of the conveyance roller pair 502.

The duplex path 52 is a path on which the sheet P that has been reversed by the reverse path 51 is conveyed upstream from the image forming device 30 in the recording medium conveyance direction by the rotation of the conveyance roller pair 501 and the sheet P is fed again to the carry-in path 301.

The controller 70 controls the operation of the entire image forming apparatus 1. The controller 70 controls, for example, an image forming operation of the image forming device 30, a drying operation of the fixing device 40, and a conveyance operation of various conveyance paths. Note that the sheet carry-in device 10 or the sheet carry-out device 90 may be controlled by another controller different from the controller 70.

The display 80 displays various data such as an operation state of the image forming apparatus 1, print setting data, and a job state. The display 80 may include a touch panel that realizes not only a display function but, for example, a touch input function.

The sheet carry-out device 90 stores the sheets P conveyed from the printer 20. The sheet carry-out device 90 includes an output tray 91 on which multiple sheets P are stacked. Each of the sheet P conveyed from the printer 20 is sequentially stacked and held on the output tray 91.

Hardware Configuration of Controller of Image Forming Apparatus

Figure 3:
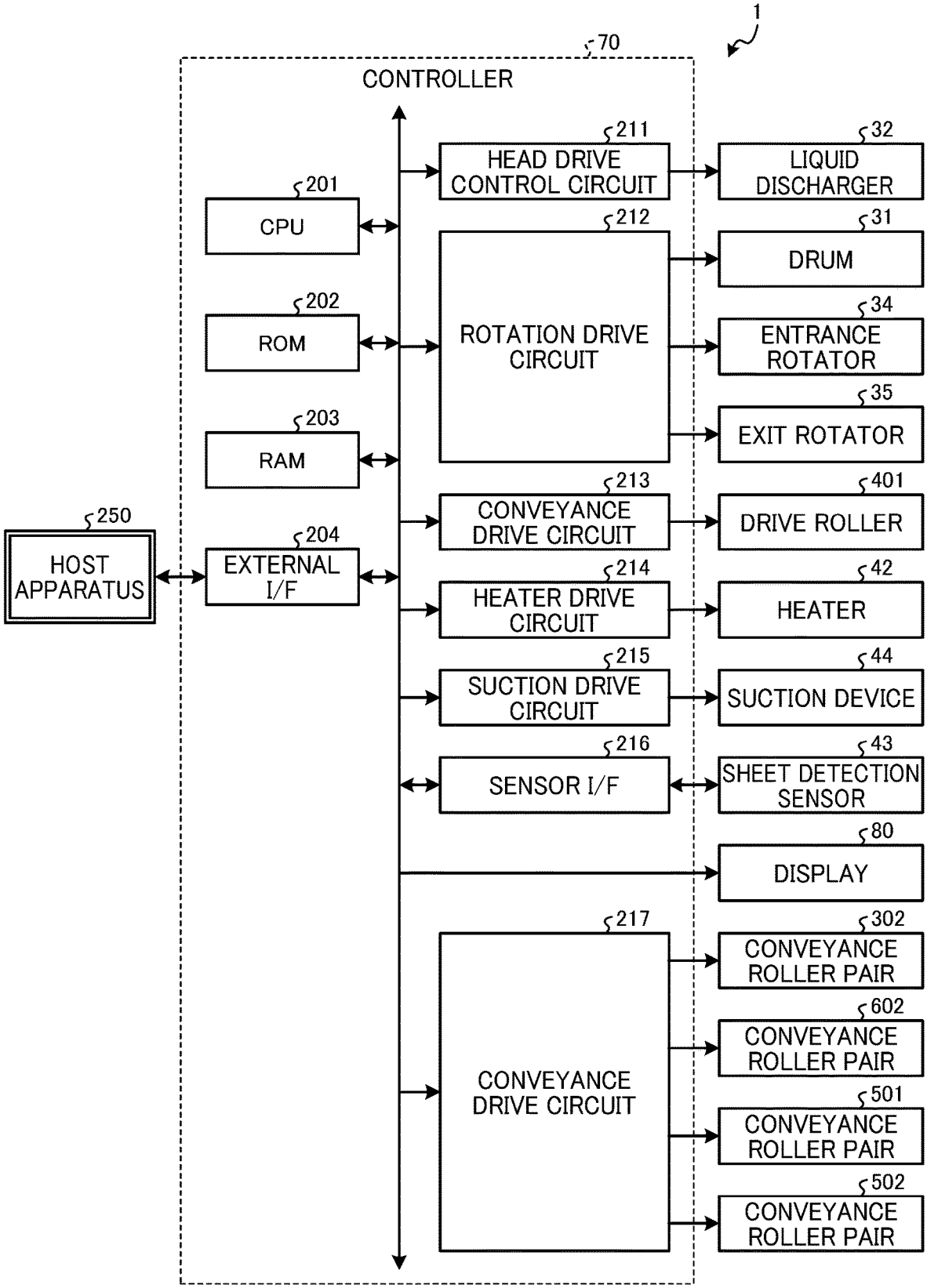
FIG. 3 is a block diagram illustrating a hardware configuration of a controller provided for the image forming apparatus of FIG. 1.

FIG. 3 is a block diagram illustrating a hardware configuration of the controller 70 of the image forming apparatus 1, according to the present embodiment. The hardware configuration of the controller 70 of the image forming apparatus 1 according to the present embodiment is described with reference to FIG. 3.

As illustrated in FIG. 3, the controller 70 includes a central processing unit (CPU) 201, a read only memory (ROM) 202, a random access memory (RAM) 203, an external I/F 204, a head drive control circuit 211, a rotation drive circuit 212, i.e., a first driver, a conveyance drive circuit 213, i.e., a second driver, a heating drive circuit 214, a suction drive circuit 215, a sensor I/F 216, and a conveyance drive circuit 217. The above-described units, devices can communicate with each other via a bus line.

The CPU 201, as an arithmetic unit, reads various programs stored in the ROM 202 and reads the programs into the RAM 203 used as a work area, to realize various functions.

The external I/F 204 is an interface for communicating with a host 250 which is an external device connected via a network such as a local area network (LAN) or a wide area network (WAN) constructed by a data transmission path such as a wired path or a wireless path. The host 250 is, for example, a data processing apparatus such as a digital front end (DFE).

The head drive control circuit 211 drives and controls the discharge operation of the liquid discharger 32 of the printer 20 based on image data in accordance with a command from the CPU 201.

The rotation drive circuit 212 drives and controls the rotation operation of the drum 31, the entrance rotator 34, and the exit rotator 35 of the image forming device 30 in accordance with a command from the CPU 201. Note that the entrance rotator 34 and the exit rotator 35 may be coupled so as to rotate in accordance with the rotation of the drum 31. In such a case, the rotation drive circuit 212 may drive and control the rotation of the drum 31.

The conveyance drive circuit 213 drives and controls the rotation of the drive roller 401 of the fixing device 40 in accordance with a command from the CPU 201 to convey the sheet P on the conveyance belt 41.

The heating drive circuit 214 drives and controls heating operation of the heater 42 of the fixing device 40 in accordance with a command from the CPU 201.

The suction drive circuit 215 drives and controls the suction operation of the suction device 44 of the fixing device 40 in accordance with a command from the CPU 201.

The sensor OF 216 receives detection data detected by various sensors such as the sheet detection sensor 43 disposed in the image forming apparatus 1.

The conveyance drive circuit 217 drives and controls rotation operations of various rollers such as the conveyance roller pair 302, the conveyance roller pair 602, the conveyance roller pair 501, and the conveyance roller pair 502 in accordance with commands from the CPU 201.

Note that the hardware configuration of the controller 70 illustrated in FIG. 3 is an example, and other components may be included in the controller 70. For example, in addition to components illustrated in FIG. 3, the controller 70 may include a non-volatile RAM (NVRAM) which is a nonvolatile memory, an application specific integrated circuit (ASIC) for executing image processing, or a field-programmable gate array (FPGA) for performing input and output signal processing.

Figure 4:
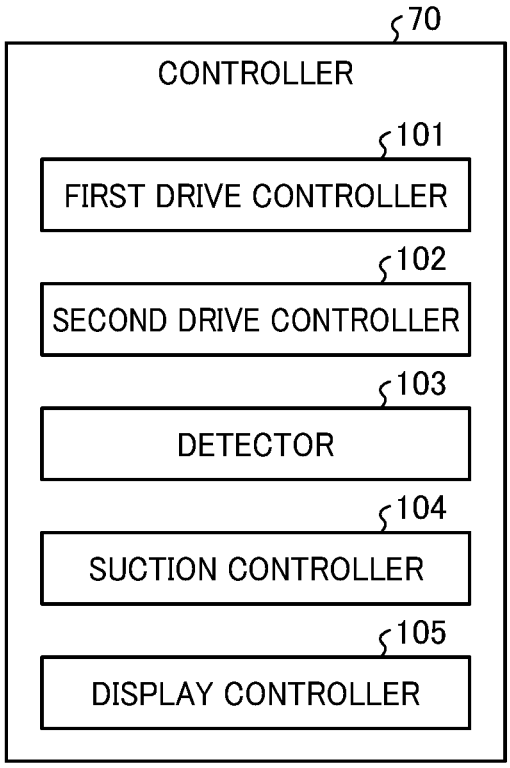
FIG. 4 is a functional block diagram illustrating a configuration of the controller provided for the image forming apparatus of FIG. 1.

Configuration and Operation of Functional Block of Controller of Image Forming Apparatus FIG. 4 is a functional block diagram illustrating a configuration of the controller 70 of the image forming apparatus 1, according to the present embodiment. With reference to FIG. 4, the configuration and operation of functional blocks of the controller 70 of the image forming apparatus 1 according to the present embodiment is described.

As illustrated in FIG. 4, the controller 70 of the image forming apparatus 1 includes a first drive controller 101, a second drive controller 102, a detector 103, a suction controller 104, and a display controller 105.

The first drive controller 101 controls the rotation of the drum 31, the entrance rotator 34, and the exit rotator 35 of the image forming device 30 via the rotation drive circuit 212 to convey the sheet P. The CPU 201 illustrated in FIG. 3 executes a program to implement the first drive controller 101.

The second drive controller 102 controls the rotation of the drive roller 401 via the conveyance drive circuit 213 to convey the sheet P on the conveyance belt 41. The CPU 201 illustrated in FIG. 3 executes a program to implement the second drive controller 102.

The detector 103 detects the sheet P that has been transferred from the exit rotator 35 to the conveyance belt 41 and conveyed to the fixing device 40 based on a detection signal, which is received by the sensor I/F 216, from the sheet detection sensor 43 for detecting the sheet P. The CPU 201 illustrated in FIG. 3 executes a program to implement the detector 103.

The suction controller 104 controls the suction operation of the suction device 44 via the suction drive circuit 215 to attract the sheet P to the conveyance belt 41. The suction controller 104 can control the suction force of the suction device 44 in multiple stages. The CPU 201 illustrated in FIG. 3 executes a program to implement the suction controller 104.

The display controller 105 controls the display operation of the display 80. The CPU 201 illustrated in FIG. 3 executes a program to implement the display controller 105.

Note that a part or all of the first drive controller 101, the second drive controller 102, the detector 103, the suction controller 104, and the display controller 105 may be implemented by an integrated circuit such as an FPGA or an ASIC, instead of a software program.

Each of the above-described functional units of the controller 70 illustrated in FIG. 4 conceptually represents a corresponding function. However, the controller 70 is not limited to such a configuration. For example, multiple functional units as independent functional units of the controller 70 illustrated in FIG. 4 may be one functional unit. On the other hand, functions of one functional unit of the controller 70 illustrated in FIG. 4 may be divided into multiple functional units that may function as the multiple functional units.

Processing for Removing Remaining Sheet in Image Forming Device

Figure 5:
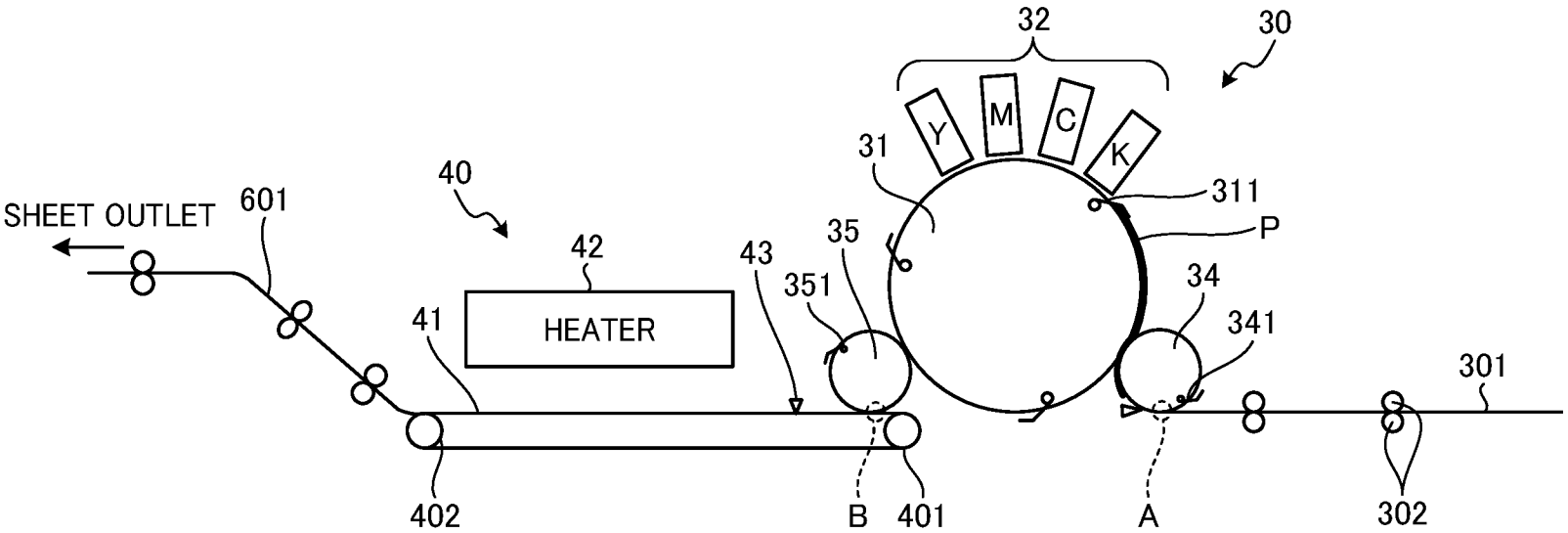
FIG. 5 is a diagram illustrating the image forming device of FIG. 2 and a fixing device provided for the image forming apparatus of FIG. 1 in a state in which a remaining sheet is present in the image forming device.
Figure 6:
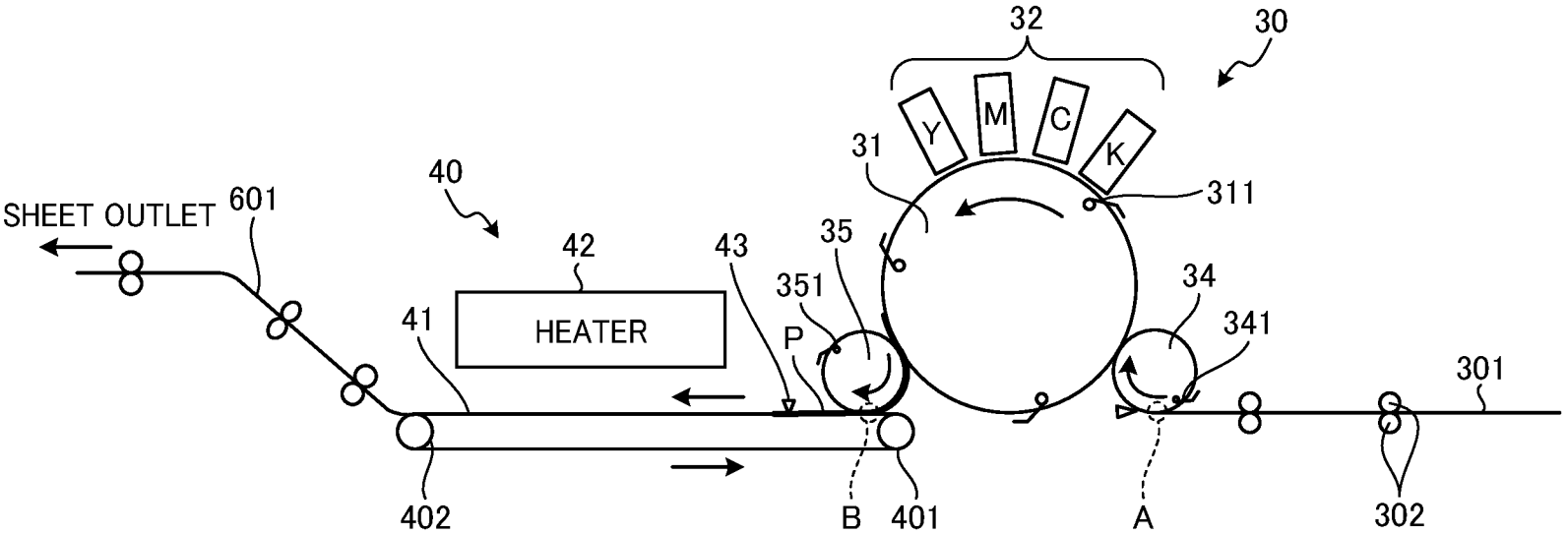
FIG. 6 is a diagram illustrating the image forming device of FIG. 2 and the fixing device of FIG. 5 in a state in which a remaining sheet is conveyed from the image forming device to the fixing device in the image forming apparatus.

FIG. 5 is a diagram illustrating the image forming device 30 in a state in which a remaining sheet is present in the image forming device 30, according to the present embodiment. FIG. 6 is a diagram illustrating the image forming device 30 in a state in which a remaining sheet is conveyed from the image forming device 30 to the fixing device 40 in the image forming apparatus 1, according to the present embodiment. An outline of a process of removing a remaining sheet from the image forming device 30 of the image forming apparatus 1 according to the present embodiment is described with reference to FIGS. 5 and 6.

When the printing processing in the image forming apparatus 1 is terminated or an emergency stop is performed due to a printing failure, as illustrated in FIG. 5, the sheet P may be present in the image forming device 30 as a remaining sheet. Note that the sheet P is present as the remaining sheet P in the image forming device 30 in a state in which the sheet P is gripped by the gripper 311 in FIG. 5. However, the present disclosure is not limited to such a configuration. For example, the sheet P may be gripped by the gripper 341 of the entrance rotator 34 or the gripper 351 of the exit rotator 35.

As described above, when the sheet P is present as the remaining sheet in the image forming device 30, it is necessary to remove the sheet P as the remaining sheet in the image forming device 30 as an initialization processing before the printer 20 performs a next printing processing. In the present embodiment, the initialization processing refers to a predetermined processing performed by the printer 20 to normally perform the printing processing before the printer 20 performs the print processing. The initialization processing includes, for example, the processing of removing the remaining sheet in the image forming device 30 described above.

As illustrated in FIG. 5, when the sheet P is present in the image forming device 30 as the remaining sheet, the first drive controller 101 needs to control the rotation operation of the drum 31, the entrance rotator 34, and the exit rotator 35 and the second drive controller 102 needs to control the conveyance operation of the conveyance belt 41 in a cooperative manner to convey the sheet P as the remaining sheet until the sheet P is detected by the sheet detection sensor 43 of the fixing device 40 as illustrated in FIG. 6. A cooperative operation by the first drive controller 101 and the second drive controller 102 is described in detail in the following description.

Timing Chart of Conveyance Driving of Image Forming Device and Fixing Device

Figure 7:
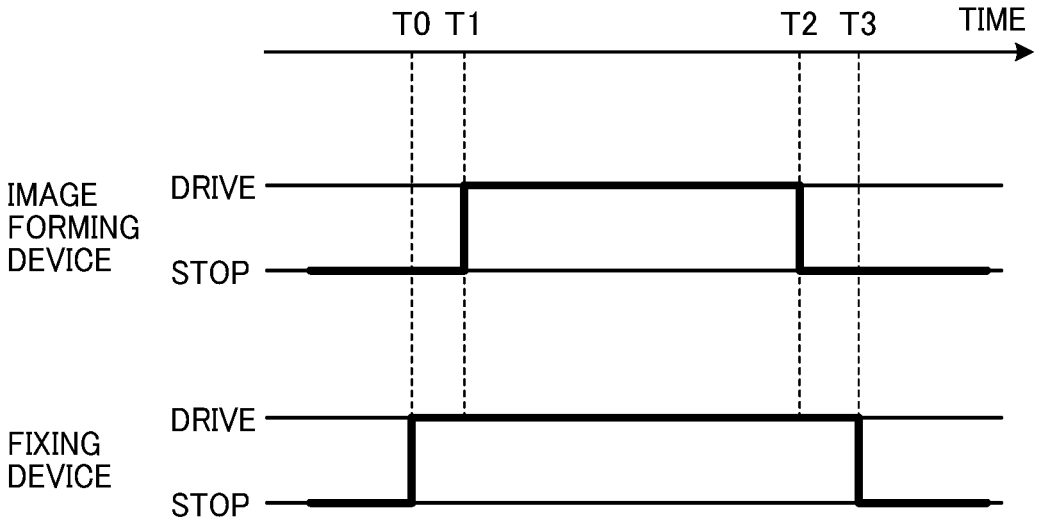
FIG. 7 is a timing chart illustrating how an image forming device and a fixing device provided for the image forming apparatus of FIG. 1 are driven for conveyance, according to an embodiment of the present disclosure.
Figure 8:
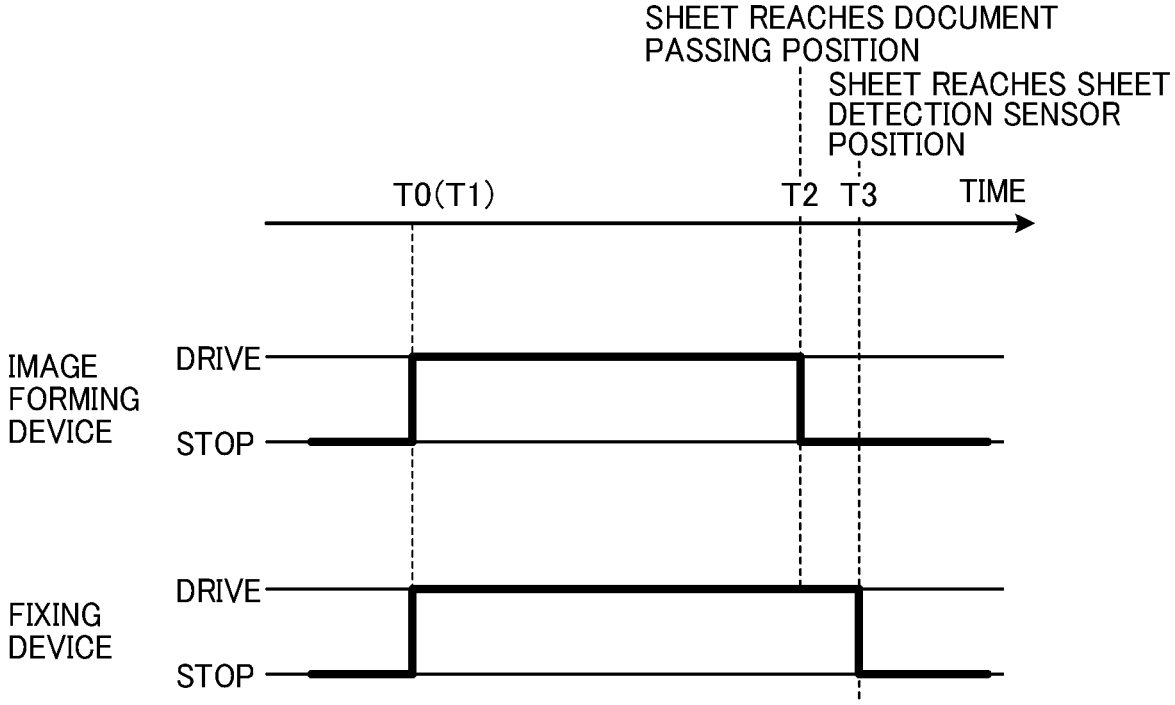
FIG. 8 is a timing chart illustrating how an image forming device and a fixing device provided for the image forming apparatus of FIG. 1 are driven for conveyance, in a case in which a remaining sheet is ejected in a minimum time necessary for the image forming apparatus, according to an embodiment of the present disclosure.
Figure 9:
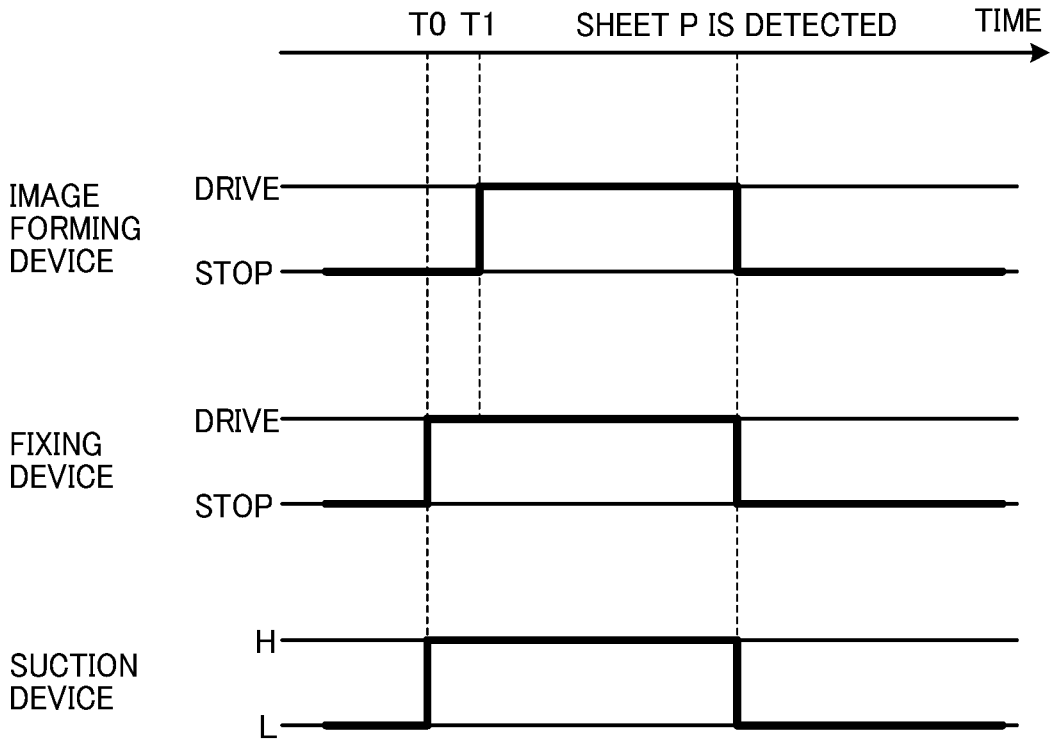
FIG. 9 is a timing chart illustrating how an image forming device and a fixing device provided for the image forming apparatus of FIG. 1 are driven for conveyance, in a case in which a remaining sheet is detected in the image forming apparatus, according to an embodiment of the present disclosure.

FIG. 7 is a timing chart illustrating how the image forming device 30 and the fixing device 40 of the image forming apparatus 1 are driven for conveyance, according to the present embodiment. FIG. 8 is a timing chart illustrating how the image forming device 30 and the fixing device 40 of the image forming apparatus 1 are driven for conveyance, in a case in which a remaining sheet is ejected in a minimum time necessary for the image forming apparatus 1, according to the present embodiment. FIG. 9 is a timing chart illustrating how the image forming device 30 and the fixing device 40 of the image forming apparatus 1 are driven for conveyance, in a case in which a remaining sheet is detected in the image forming apparatus 1, according to the present embodiment. A timing chart that illustrates how the image forming device 30 and the fixing device 40 are driven to convey a remaining sheet in the initialization processing of the image forming apparatus 1 is described with reference to FIGS. 7, 8, and 9.

First, as illustrated in FIG. 7, at a timing T0, the second drive controller 102 of the controller 70 controls the rotation operation of the drive roller 401 via the conveyance drive circuit 213 to drive the conveyance belt 41 for conveyance. In the following description, when the second drive controller 102 controls the rotation of the drive roller 401 via the conveyance drive circuit 213 to drive the conveyance belt 41 for conveyance, such an operation may be simply referred to as drive the fixing device 40 for conveyance.

Next, at a timing T1, which is equal to or greater than TO, the first drive controller 101 of the controller 70 controls the rotation operation of the drum 31, the entrance rotator 34, and the exit rotator 35 of the image forming device 30 via the rotation drive circuit 212 to drive the image forming device 30 for conveyance. In the following description, when the first drive controller 101 controls the rotation operation of the drum 31, the entrance rotator 34, and the exit rotator 35 of the image forming device 30 via the rotation drive circuit 212 to drive the conveyance belt 41, such an operation may be simply referred to as drive the image forming device 30 for conveyance.

As described above, after the timing T1, the second drive controller 102 drives the fixing device 40 for conveyance and the first drive controller 101 drives the image forming device 30 for conveyance. Accordingly, the sheet P present as the remaining sheet in the image forming device 30 is conveyed from the image forming device 30 toward the fixing device 40.

Next, the first drive controller 101 stops driving the image forming device 30 for conveyance at a timing T2, which is greater than T1. Further, the second drive controller 102 stops driving the fixing device 40 for conveyance at a timing T3, which is greater than T2.

As described above, driving the image forming device 30 for conveyance by the first drive controller 101 and driving the fixing device 40 for conveyance by the second drive controller 102 are performed so as to satisfy conditions of following formulas 1, 2, and 3 with respect to the timing T0, T1, T2, and T3.

$T0$ is equal to or smaller than $T1$ ($T0 \leq T1$) Formula 1.

Time necessary for the sheet $P$ to be conveyed from the receiving position $A$ on the entrance rotator 34 to the receiving position $B$ on the exit rotator 35) is equal to or smaller than ($\leq$) $T2-T1$ Formula 2.

Time necessary for the sheet $P$ to be conveyed from the delivery position $B$ on the exit rotator 35 to the sheet detection sensor 43 on the fixing device 40) is equal to or smaller than ($\leq$) $T3-T2$ Formula 3.

Satisfying the above-described formula 1 allows the image forming device 30 to be driven for conveyance before the fixing device 40 is driven for conveyance. Accordingly, a state in which a remaining sheet is clogged at the delivery position B because the conveyance belt 41 is not driven for conveyance can be avoided. Satisfying the above-described formula 2 allows the remaining sheet to be conveyed to the delivery position B on the exit rotator 35 without fail even if the remaining sheet is present in the vicinity of the receiving position A on the entrance rotator 34. Satisfying the above-described formula 3 allows the remaining sheet to be conveyed to the sheet detection sensor 43 without fail after the remaining sheet is delivered from the exit rotator 35 to the conveyance belt 41 at the delivery position B. Such a configuration as described above allows the sheet P to be conveyed to the sheet detection sensor 43 without fail when the sheet P is present as the remaining sheet in the image forming device 30.

Further, driving for conveyance by the first drive controller 101 and the second drive controller 102 is performed so as to satisfy the conditions of following formulas 4, 5, and 6 in which inequality signs are replaced with equal signs for the formulas 1, 2, and 3 described above with respect to the timings T0, T1, T2, and T3. Accordingly, the sheet P can be conveyed to the sheet detection sensor 43 in a minimum necessary time according to the timing chart illustrated in FIG. 8. Thus, the time necessary for the initialization processing can be reduced.

$T0$ is equal to $T1$ ($T0=T1$) Formula 4.

Time necessary for the sheet $P$ to be conveyed from the receiving position $A$ on the entrance rotator 34 to the receiving position $B$ on the exit rotator 35$=T2-T1$ Formula 5.

Time necessary for the sheet $P$ to be conveyed from the delivery position $B$ on the exit rotator 35 to the sheet detection sensor 43 of the fixing device 40$=T3-T2$ Formula 6.

In this case, for example, when a remaining sheet is present at the receiving position A on the entrance rotator 34, driving the image forming device 30 for conveyance by the first drive controller 101 and driving the fixing device 40 for conveyance by the second drive controller 102 are simultaneously started at the timing T0 or T1. Accordingly, the sheet P as the remaining sheet reaches the delivery position B at the timing T2. Then, the sheet P reaches a position detected by the sheet detection sensor 43 at the timing T3.

The timing at which the remaining sheet is detected by the detector 103 differs depending on the position of the remaining sheet in the image forming device 30. Accordingly, when driving by the first drive controller 101 and the second drive controller 102 for conveyance is performed in accordance with the timing chart illustrated in FIG. 7 or FIG. 8, the sheet P as the remaining sheet may be detected by the detector 103 before the sheet P reaches the timing T3. It is not necessary to continue driving the image forming device 30 for conveyance by the first drive controller 101 and driving the fixing device 40 for conveyance by the second drive controller 102 at a timing at which the sheet P as the remaining sheet is detected by the detector 103. Accordingly, driving the image forming device 30 for conveyance by the first drive controller 101 and driving the fixing device 40 for conveyance by the second drive controller 102 may be stopped at a timing at which the remaining sheet is detected by the detector 103 as illustrated in FIG. 9. Further, as illustrated in FIG. 9, the suction operation of the suction device 44 by the suction controller 104 via the suction drive circuit 215 is turned on and off in accordance with the turning on and off of driving the fixing device 40 for conveyance by the second drive controller 102. Accordingly, the sheet P is sucked and attracted to the conveyance belt 41 by a suction force H that can reliably hold the sheet P while the fixing device 40 is driven for conveyance and the sheet P is sucked by a suction force L, which has a weak suction force or no suction force, that can remove the sheet P from the conveyance belt 41 when driving the fixing device 40 for conveyance is stopped. Thus, when the sheet P is detected, the suction force of the conveyance belt 41 is weakened such that the remaining sheet on the conveyance belt 41 can be easily removed.

Flow of Remaining Sheet Ejection Processing in Initialization Processing

Figure 10:
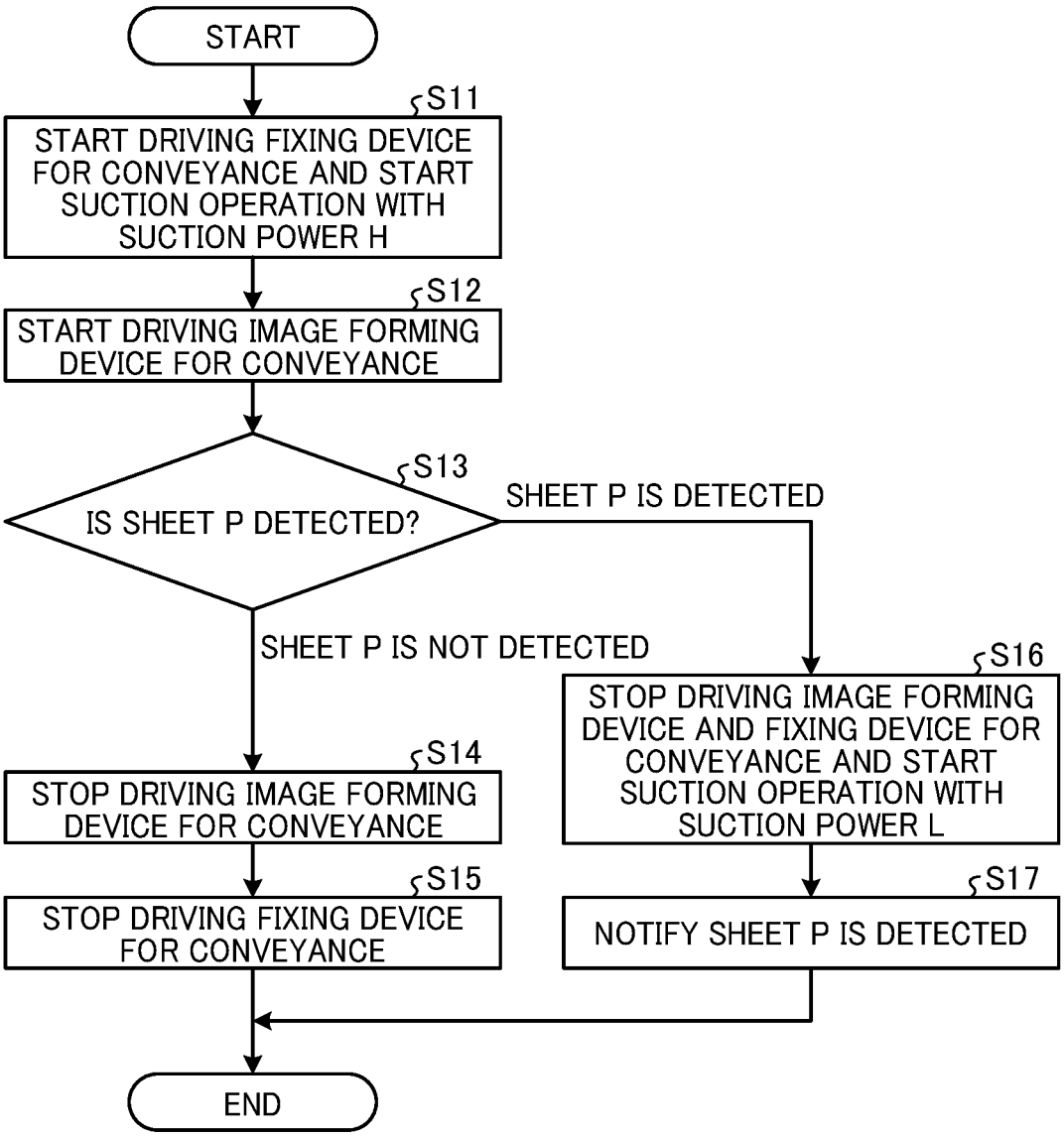
FIG. 10 is a flowchart illustrating a procedure of ejection processing of a remaining sheet performed by an image forming apparatus, according to an embodiment of the present disclosure.

FIG. 10 is a flowchart illustrating a procedure of remaining sheet ejection processing performed in the image forming apparatus 1, according to the present embodiment. With reference to FIG. 10, the procedure of the remaining sheet ejection processing in the initialization processing of the image forming apparatus 1 according to the present embodiment is described. Note that in FIG. 10, driving the image forming device 30 for conveyance by the first drive controller 101 and driving the fixing device 40 for conveyance by the second drive controller 102 is performed in accordance with the timing chart illustrated in FIG. 7.

Step S11

At the timing T0, the second drive controller 102 drives the fixing device 40 for conveyance, and at the same time, the suction controller 104 causes the suction device 44 to perform the suction operation with the suction force H via the suction drive circuit 215. Then, the process proceeds to step S12.

Step S12

The first drive controller 101 drives the image forming device 30 for conveyance at the timing T1. Accordingly, the sheet P that is present in the image forming device 30 as a remaining sheet is conveyed from the image forming device 30 toward the fixing device 40. Then, the process proceeds to step S13.

Step S13

If the detector 103 does not detect the sheet P as the remaining sheet based on a detection signal from the sheet detection sensor 43 (NO in step S13) even at the timing T2, the process proceeds to step S14. On the other hand, when the detector 103 detects the sheet P as the remaining sheet based on a detection signal from the sheet detection sensor 43 before the sheet P reaches the timing T2 (YES in step S13), the process proceeds to step S16.

Step S14

At the timing T2, the first drive controller 101 stops driving the image forming device 30 for conveyance. Then, the process proceeds to step S15.

Step S15

Then, at the timing T3, the second drive controller 102 stops driving the fixing device 40 for conveyance.

Step S16

When the sheet P is detected by the detector 103, the first drive controller 101 stops driving the image forming device 30 for conveyance and the second drive controller 102 stops driving the fixing device 40 for conveyance. Then, the suction controller 104 switches the suction force generated by the suction device 44 from the suction force H to the suction force L via the suction drive circuit 215. Then, the process proceeds to step S17.

Step S17

Then, the display controller 105 causes the display 80 to notify, i.e., display that the sheet P as the remaining sheet is detected by the detector 103. As described above, the user can recognize the remaining sheet is present in the image forming device 30 and take appropriate measures such as removing the remaining sheet.

The remaining sheet ejection processing in the initialization processing of the image forming apparatus 1 is executed in the above-described procedure of steps S11, S12, S13, S14, S15, S16, and S17.

As described above, the image forming apparatus 1 according to the embodiments of the present disclosure includes the drum 31 for rotating and conveying a sheet P while carrying the sheet P on the drum 31, the entrance rotator 34 for receiving the sheet P conveyed from upstream in the recording medium conveyance direction at the receiving position A and delivering the sheet P to the drum 31 while bearing and conveying the sheet P, the exit rotator 35 for receiving the sheet P conveyed by the rotation of the drum 31 and delivering the sheet P at the delivery position B downstream in the recording medium conveyance direction while rotating and conveying the sheet P, the rotation drive circuit 212 for rotating the drum 31, the entrance rotator 34, and the exit rotator 35, the conveyance belt 41 for receiving the sheet P conveyed by the rotation of the exit rotator 35 at the second position and conveying the sheet P downstream in the recording medium conveyance direction, the conveyance drive circuit 213 for driving the conveyance belt 41, and the sheet detection sensor 43 for detecting the sheet P in the conveyance path in which the sheet P is conveyed by the conveyance belt 41. As a process (initialization processing) for removing the sheet P remaining on the drum 31, the entrance rotator 34, and the exit rotator 35, the rotation drive circuit 212 starts the rotation operation after driving by the conveyance drive circuit 213 for conveyance is started. The rotation drive circuit 212 rotates the drum 31, the entrance rotator 34, and the exit rotator 35 for a period longer than the time necessary to convey the sheet P from the receiving position A to the delivery position B. The conveyance drive circuit 213 continues driving the conveyance belt 41 for conveyance for a period of time equal to or longer than the time necessary to convey the sheet P from the delivery position B until the sheet detection sensor 43 detects the sheet P after the rotation operation by the rotation drive circuit 212 is stopped. Accordingly, when the sheet P is present as a remaining sheet on the drum surface of the image forming device 30, the remaining sheet can be ejected without fail.

Modification

An image forming apparatus 1*a* as an example of a conveyance apparatus according to a modification of the present disclosure is described focusing on points different from the image forming apparatus 1 according to the above-described embodiments.

Figure 11:
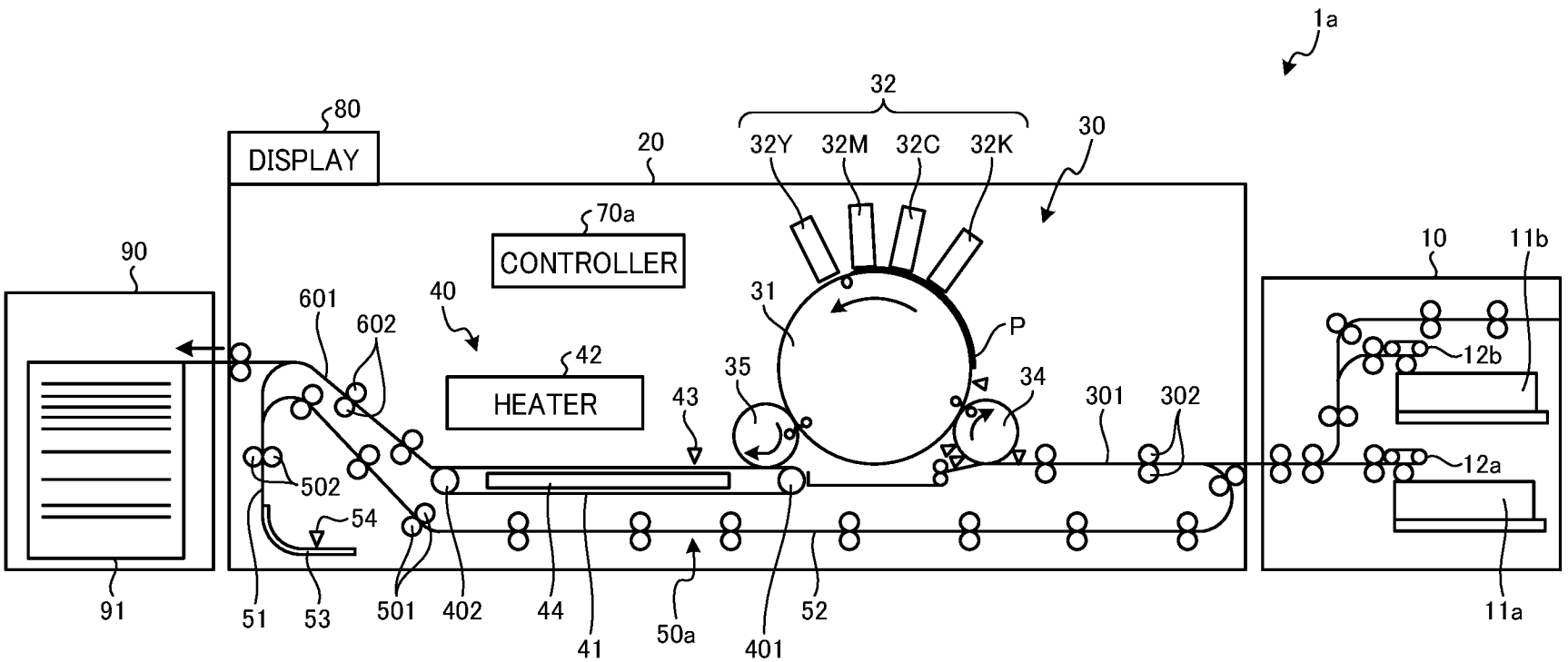
FIG. 11 is a diagram illustrating an overall configuration of an image forming apparatus according to a modification of the above embodiments of the present disclosure.

FIG. 11 is a diagram illustrating an overall configuration of the image forming apparatus 1*a* according to the modification of the above embodiments of the present disclosure. The overall configuration of the image forming apparatus 1*a* according to the modification is described with reference to FIG. 11.

In the modification, as illustrated in FIG. 11, the printer 20 of the image forming apparatus 1*a* includes the image forming device 30, the fixing device 40, a duplex mechanism 50*a*, a controller 70*a*, and the display 80.

The duplex mechanism 50*a* reverses a sheet P that has passed through the fixing device 40 and feeds the sheet P again upstream from the image forming device 30, i.e., to the carry-in path 301 when printing is performed on both sides of the sheet P. As illustrated in FIG. 11, the duplex mechanism 50*a* includes the reverse path 51, the duplex path 52, a purge tray 53, and a purge tray sensor 54.

The purge tray 53 serves as a tray on which a remaining sheet present in the image forming device 30 is conveyed via the ejection path 601 and the reverse path 51 and accumulated by an initialization processing performed on the remaining sheets.

The purge tray sensor 54 detects, for example, whether the purge tray 53 is full of the remaining sheets accumulated in the purge tray 53.

Note that other configuration of the image forming apparatus 1*a* according to the modification illustrated in FIG. 11 is similar to the configuration of the image forming apparatus 1 according to the above-described embodiments.

Figure 12:
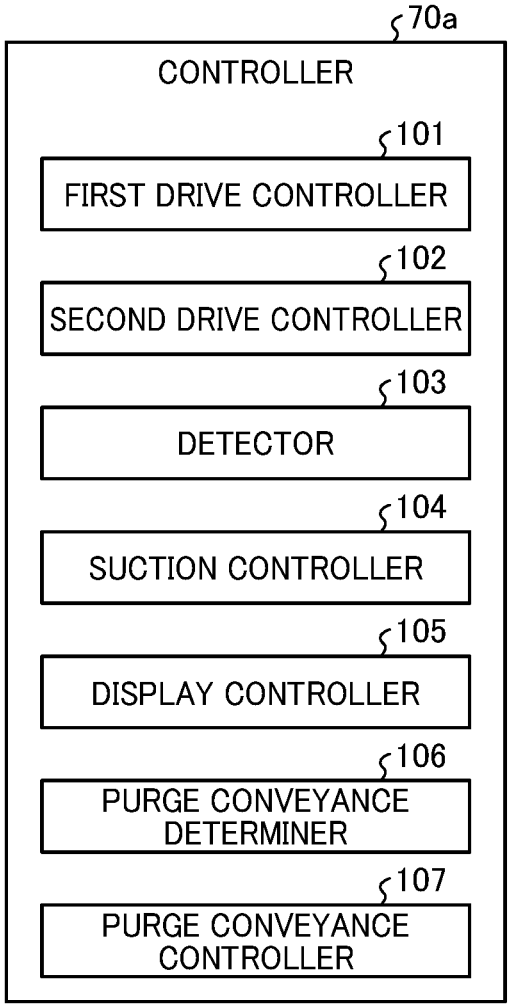
FIG. 12 is a functional block diagram illustrating a configuration of a controller provided for the image forming apparatus according to the modification of the present disclosure.

FIG. 12 is a functional block diagram illustrating a configuration of the controller 70*a* according to the modification of the above embodiments. With reference to FIG. 12, the configuration and operation of functional blocks of the controller 70*a* of the image forming apparatus 1*a* according to the modification is described below.

As illustrated in FIG. 12, the controller 70*a* of the image forming apparatus 1 includes the first drive controller 101, the second drive controller 102, the detector 103, the suction controller 104, the display controller 105, a purge conveyance determiner 106, and a purge conveyance controller 107.

The purge conveyance determiner 106 determines whether the purge tray 53 is full of remaining sheets accumulated in the purge tray 53, in other words, whether the remaining sheets can be conveyed to the purge tray 53, based on a detection signal from the purge tray sensor 54 received by the sensor I/F 216. The purge conveyance determiner 106 is implemented by executing a program by the CPU 201 illustrated in FIG. 3.

The purge conveyance controller 107 controls the rotation of the conveyance roller pair 602 and the conveyance roller pair 502 via the conveyance drive circuit 217 to convey the sheet P as a remaining sheet conveyed through the ejection path 601 to the purge tray 53. The purge conveyance controller 107 is implemented by executing a program by the CPU 201 illustrated in FIG. 3.

Note that the operations of other functional units, i.e., the first drive controller 101, the second drive controller 102, the detector 103, the suction controller 104, and the display controller 105 of the controller 70*a* are the same as the operations of the functional units, i.e., the first drive controller 101, the second drive controller 102, the detector 103, the suction controller 104, and the display controller 105 of the controller 70 according to the above-described embodiments.

In addition, a part or all of the functions of the first drive controller 101, the second drive controller 102, the detector 103, the suction controller 104, the display controller 105, the purge conveyance determiner 106, and the purge conveyance controller 107 may be implemented by an integrated circuit such as an FPGA or an ASIC, instead of a program which is software.

Each functional unit of the controller 70*a* illustrated in FIG. 12 conceptually represents a function. However, the controller 70*a* is not limited to such a configuration. For example, multiple functional units illustrated as independent functional units of the controller 70*a* illustrated in FIG. 12 may be as one functional unit. On the other hand, the controller 70*a* illustrated in FIG. 12 may divide functions of one functional unit into multiple functional units that serve as the multiple functional units.

Figure 13:
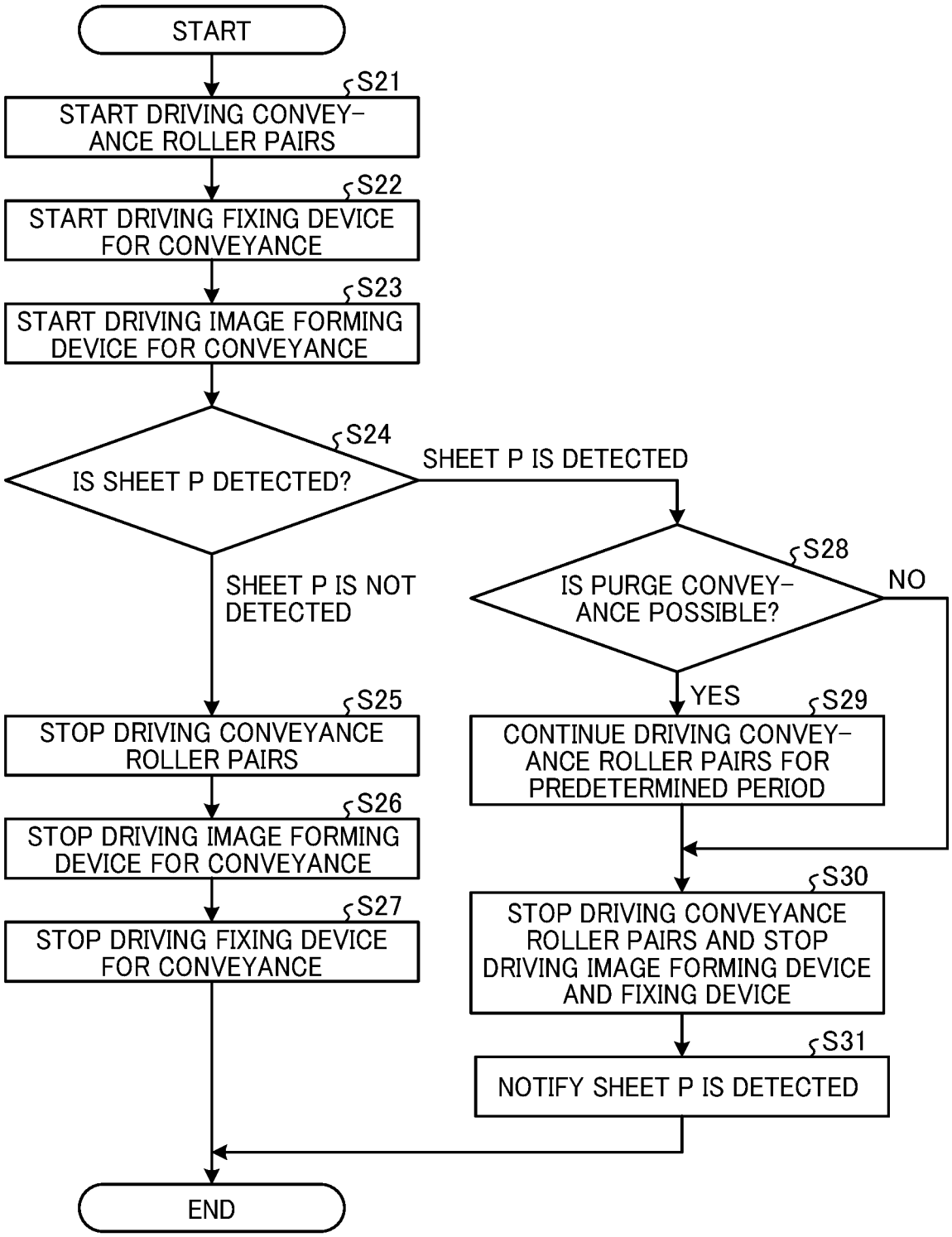
FIG. 13 is a flowchart illustrating a procedure of ejection processing of a remaining sheet performed by an image forming apparatus, according to the modification the present disclosure.

FIG. 13 is a flowchart illustrating a procedure of ejection processing of a remaining sheet performed in the image forming apparatus 1*a*, according to a modification of the above embodiments of the present disclosure. With reference to FIG. 13, the procedure of the ejection processing of the remaining sheet in the initialization processing of the image forming apparatus 1*a* according to the modification is described. Note that in FIG. 13, a timing at which the image forming device 30 and the fixing device 40 are driven for conveyance by the first drive controller 101 and the second drive controller 102, respectively, is in accordance with the operation of the timing chart illustrated in FIG. 7.

Step S21

The purge conveyance controller 107 starts driving the rotation operation of the conveyance roller pair 602 and the conveyance roller pair 502 via the conveyance drive circuit 217. Then, the process proceeds to step S22.

Step S22

The second drive controller 102 drives the fixing device 40 for conveyance at the timing T0. Then, the process proceeds to step S23.

Step S23

The first drive controller 101 drives the image forming device 30 for conveyance at the timing T1. Accordingly, the sheet P that is present in the image forming device 30 as a remaining sheet is conveyed from the image forming device 30 to the fixing device 40. Then, the process proceeds to step S24.

Step S24

If the detector 103 does not detect the sheet P as the remaining sheet based on a detection signal from the sheet detection sensor 43 (NO in step S24) even at the timing T2, the process proceeds to step S25. On the other hand, if the detector 103 detects the sheet P as the remaining sheet based on a detection signal from the sheet detection sensor 43 (YES in step S24), the process proceeds to step S28.

Step S25

The purge conveyance controller 107 stops driving the rotation operation of the conveyance roller pair 602 and the conveyance roller pair 502 via the conveyance drive circuit 217. Then, the process proceeds to step S26.

Step S26

Subsequently, at the timing T2, the first drive controller 101 stops driving the image forming device 30 for conveyance. Then, the process proceeds to step S27.

Step S27

At the timing T3, the second drive controller 102 stops driving the fixing device 40 for conveyance.

Step S28

Based on a detection signal from the purge tray sensor 54, the purge conveyance determiner 106 determines whether the purge tray 53 is full of accumulated remaining sheets, in other words, whether remaining sheets can be conveyed to the purge tray 53. When the remaining sheets can be conveyed to the purge tray 53 (YES in step S28), the process proceeds to step S29. When the conveyance of the remaining sheets to the purge tray 53 is not possible (NO in step S28), the process proceeds to step S30.

Step S29

When it is determined by the purge conveyance determiner 106 that the remaining sheets can be conveyed to the purge tray 53, the purge conveyance controller 107 continues driving the rotation operation of the conveyance roller pair 602 and the conveyance roller pair 502 via the conveyance drive circuit 217 for a further predetermined time. Accordingly, the sheets P detected by the detector 103 are conveyed through the ejection path 601 and the reverse path 51 and accumulated in the purge tray 53. Then, the process proceeds to step S30.

Step S30

The purge conveyance controller 107 stops driving the rotation operation of the conveyance roller pair 602 and the conveyance roller pair 502 via the conveyance drive circuit 217. Further, the first drive controller 101 stops driving the image forming device 30 for conveyance, and the second drive controller 102 stops driving the fixing device 40 for conveyance. Then, the process proceeds to step S31.

Step S31

The display controller 105 notifies that the sheet P as the remaining sheet has been detected on the display 80.

In the procedure of steps S21, S22, S23, S24, S25, S26, S27, S29, S30, and S31 described above, the remaining sheet ejection processing in the initialization processing of the image forming apparatus 1*a* is executed. Note that, similar to the operation illustrated in FIG. 11, the suction operation by the suction device 44 may be combined with driving the fixing device 40 for conveyance.

As described above, the image forming apparatus 1*a* according to the modification additionally includes the purge tray 53 on which sheets P are accumulated, downstream from the conveyance belt 41 in the recording medium conveyance direction. When a sheet P is detected by the sheet detection sensor 43 and the sheet P can be accumulated in the purge tray 53, the rotation driving circuit 212 continues the rotation of the drum 31, the entrance rotator 34, and the exit rotator 35 for a predetermined time. The conveyance drive circuit 213 continues driving the conveyance belt 41 for conveyance for a predetermined time. Accordingly, the sheets P as the remaining sheets can be accumulated on the purge tray 53 so that the remaining sheets can be easily collected.

Note that examples of removing the remaining sheets in the image forming device 30 have been described in the above-described embodiments and modification. However, the embodiments and the modification of the present disclosure is not limited to the image forming device 30 and can be applied to a drum-shaped rotator that conveys a print medium such as the drum 31, the entrance rotator 34, and the exit rotator 35. For example, the fixing device 40 may include a drum-shaped rotator on a conveyance path, and a print medium is heated while the print medium is conveyed by the rotator. In this case, the operations described in the above-described embodiments and modification can be applied to the remaining sheet removal processing in the fixing device 40. Further, the remaining sheet removal processing according to the present embodiment is not only applied to the image forming apparatus 1 but to any conveyance apparatus in which a recording medium is conveyed by drum-shaped rotators.

In the above-described embodiments and modification, when at least one of the functional units of the controller 70 of the image forming apparatus 1 and the controller 70*a* of the image forming apparatus 1*a* is implemented by executing a program, the program is provided, for example, in a ROM in advance. Further, the program executed by the controller 70 of the image forming apparatus 1 according to the above-described embodiments and the controller 70*a* of the image forming apparatus 1*a* according to the modification may be recorded and provided in an installable or executable format file on a computer-readable recording medium such as a compact disc read only memory (CD-ROM), a flexible disk (FD), a compact disc-recordable (CD-R), or a digital video disc (DVD). The program executed by the controller 70 of the image forming apparatus 1 according to the above-described embodiments and the controller 70*a* of the image forming apparatus 1*a* according to the modification may be stored on a computer connected to a network such as the Internet and downloaded and provided via the network. The program executed by the controller 70 of the image forming apparatus 1 according to the above-described embodiments and the controller 70*a* of the image forming apparatus 1*a* according to the modification may be provided or distributed via a network such as the Internet. In addition, the program executed by the controller 70 of the image forming apparatus 1 according to the above-described embodiments and the controller 70*a* of the image forming apparatus 1*a* according to the modification have a module configuration including at least one of the above-described functional units. A CPU as hardware reads the program from the above-described storage device and executes the program. Accordingly, the above-described functional units are loaded onto a main storage device and generated.

Further, each function in the above-described embodiments can be realized by one or more processing circuits. In the present embodiment, the term processing circuit includes a processor programmed by software to execute each function, such as a processor implemented by an electronic circuit, and a device such as an application specific integrated circuit (ASIC), a digital signal processor (DSP), a field-programmable gate array (FPGA) or a circuit module known in the art designed to execute each of the above-described functions.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. Any one of the above-described operations may be performed in various other ways, for example, in an order different from the one described above.

The invention claimed is:

1. A conveyance apparatus comprising:

a bearing rotator configured to rotate, while bearing a recording medium, to convey the recording medium;

an entrance rotator configured to receive, at a first position, the recording medium fed from upstream in a recording medium conveyance direction and deliver the recording medium to the bearing rotator while rotating to convey the recording medium;

an exit rotator configured to receive the recording medium conveyed by rotation of the bearing rotator and deliver the recording medium at a second position downstream in the recording medium conveyance direction while rotating to convey the recording medium;

a first driver circuit configured to rotate the bearing rotator, the entrance rotator, and the exit rotator;

a downstream conveyor configured to receive, at the second position, the recording medium conveyed by rotation of the exit rotator and convey the recording medium downstream in the recording medium conveyance direction;

a second driver circuit configured to drive the downstream conveyor for conveyance; and a recording medium detector configured to detect the recording medium on a conveyance path on which the recording medium is conveyed by the downstream conveyor, wherein the first driver circuit is configured to: as a process of removing the recording medium remaining on at least one of the bearing rotator, the entrance rotator, or the exit rotator, start rotation operation after the second driver circuit starts driving the downstream conveyor for conveyance; and rotate the bearing rotator, the entrance rotator, and the exit rotator for a period of time equal to or longer than a period of time taken for the recording medium to be conveyed from the first position to the second position, and wherein the second driver circuit is configured to continue driving the downstream conveyor for conveyance for a period of time equal to or longer than a period of time taken for the recording medium to be conveyed from the second position to a position at which the recording medium is detected by the recording medium detector after the rotation operation of the first driver circuit is stopped.

2. The conveyance apparatus according to claim 1, wherein the first driver circuit is configured to:

start the rotation operation at a same time as a time at which the second driver circuit starts driving the downstream conveyor for conveyance; and rotate the bearing rotator, the entrance rotator, and the exit rotator for the period of time taken for the recording medium to be conveyed from the first position to the second position, and wherein the second driver circuit is configured to continue driving the downstream conveyor for conveyance for the period of time taken for the recording medium to be conveyed from the second position to the position at which the recording medium is detected by the recording medium detector after the rotation operation of the first driver circuit is stopped.

3. The conveyance apparatus according to claim 1, wherein, when the recording medium is detected by the recording medium detector, the first driver circuit is configured to stop rotation of the bearing rotator, the entrance rotator, and the exit rotator and the second driver circuit is configured to stop driving the downstream conveyor for conveyance.

4. The conveyance apparatus according to claim 1, further comprising a purge tray downstream from the downstream conveyor in the recording medium conveyance direction, the purge tray configured to accumulate recording media, wherein, when the recording medium is detected by the recording medium detector and can be accumulated on the purge tray, the first driver circuit is configured to continue rotation of the bearing rotator, the entrance rotator, and the exit rotator for a predetermined period of time and the second driver circuit is configured to continue driving the downstream conveyor for conveyance for a predetermined period of time.

5. The conveyance apparatus according to claim 4, wherein, when the recording medium is detected by the recording medium detector and can be accumulated on the purge tray, the first driver circuit is configured to stop the rotation of the bearing rotator, the entrance rotator, and the exit rotator and the second driver circuit is configured to stop driving the downstream conveyor for conveyance.

6. The conveyance apparatus according to claim 1, further comprising a suction device configured to suck the recording medium conveyed by the downstream conveyor to attract the recording medium to the downstream conveyor, wherein the suction device is configured to suck the recording medium while the second driver circuit drives the downstream conveyor for conveyance to convey the recording medium.

7. The conveyance apparatus according to claim 1, further comprising a notification device configured to notify that the recording medium is detected when the recording medium is detected by the recording medium detector.

8. An image forming apparatus comprising the conveyance apparatus according to claim 1.

* * * * *